US012128285B1

(12) United States Patent
Abi Nader et al.

(10) Patent No.: US 12,128,285 B1
(45) Date of Patent: Oct. 29, 2024

(54) INTERACTIVE MARTIAL ARTS TRAINING SYSTEM

(71) Applicants: Fares Abi Nader, Nice (FR); Hagop Dantziguian, Sin El Fil-Meten (LB)

(72) Inventors: Fares Abi Nader, Nice (FR); Hagop Dantziguian, Sin El Fil-Meten (LB)

( * ) Notice: Subject to any disclaimer, the term of this patent is extended or adjusted under 35 U.S.C. 154(b) by 141 days.

(21) Appl. No.: 17/834,539

(22) Filed: Jun. 7, 2022

Related U.S. Application Data

(60) Provisional application No. 63/311,964, filed on Feb. 19, 2022.

(51) Int. Cl.
*A63B 69/24* (2006.01)
*A63B 69/32* (2006.01)
*A63B 71/06* (2006.01)

(52) U.S. Cl.
CPC ..... *A63B 69/244* (2022.08); *A63B 69/322* (2022.08); *A63B 71/0619* (2013.01); *A63B 2220/53* (2013.01); *A63B 2220/833* (2013.01); *A63B 2225/093* (2013.01); *A63B 2225/20* (2013.01); *A63B 2244/10* (2013.01)

(58) Field of Classification Search
CPC . A63B 69/244; A63B 69/322; A63B 71/0619; A63B 2220/53; A63B 2220/833; A63B 2225/093; A63B 2225/20; A63B 2244/10
See application file for complete search history.

(56) References Cited

U.S. PATENT DOCUMENTS 4,765,609 A * 8/1988 Wilson ..... A63B 69/22 482/901
11,311,787 B2 * 4/2022 Kawar ..... A63B 69/244
2008/0119335 A1 * 5/2008 Luigi ..... A63B 69/30 482/84
2010/0261580 A1 * 10/2010 Lannon ..... A63B 21/00076 482/93
2013/0065731 A1 * 3/2013 Jones ..... A63B 69/22 482/8
2014/0128226 A1 * 5/2014 Chang ..... A63B 69/22 482/83
2014/0243165 A1 * 8/2014 Hall ..... A63B 69/24 482/83
2020/0215403 A1 * 7/2020 Nader ..... A63B 71/023
2021/0283482 A1 * 9/2021 Wu ..... A63B 69/20

(Continued)

*Primary Examiner* — Loan B Jimenez
*Assistant Examiner* — Andrew M Kobylarz
(74) *Attorney, Agent, or Firm* — Michael D. Eisenberg

(57) ABSTRACT

A training system for martial arts training, comprising: (a) a vertical primary support frame configured to be fixed to a ground; (b) a secondary frame slidable vertically on the primary support frame and lockable on the primary support frame at a desired height; (c) a plurality of linear actuators joined to the secondary frame, each linear actuator having an end configured to extend and retract; (d) a plurality of hitting pads, each of the hitting pads being joined to the end of a respective one of the linear actuators; (e) a control apparatus connected to the plurality of linear actuators and configured to control a position of the end of each linear actuator, thereby controlling the position of the hitting pads; (f) a plurality of sensors operatively connected to respective linear actuators and in communication with the control apparatus, the sensors being for sensing impacts to respective hitting pads.

15 Claims, 12 Drawing Sheets

(56) References Cited

U.S. PATENT DOCUMENTS

| | | | | |
|---|---|---|---|---|
| 2022/0016509 | A1* | 1/2022 | Fazio | A63B 69/22 |
| 2022/0062730 | A1* | 3/2022 | Verdialez | A63B 71/0622 |
| 2022/0080279 | A1* | 3/2022 | Kawar | A63B 24/0021 |

* cited by examiner

100

INTERACTIVE MARTIAL ARTS TRAINING SYSTEM

CROSS-REFERENCES TO RELATED APPLICATIONS

This application claims priority from U.S. Provisional Application Ser. No. 63/311,964 filed Feb. 19, 2022, which is hereby incorporated herein by reference in the respective in its entirety.

TECHNICAL FIELD

The present invention relates generally to martial arts training equipment, and particularly to training equipment having a plurality of hitting pads whose positions are controlled by automatically operated actuators.

BACKGROUND OF THE INVENTION

Interactive martial arts training equipment are generally passive hitting units. In other words, the user or athlete strikes, through punches or kicks, one or more of several hitting pads, which either remain static in response to the forces imparted, or which retract to a second position until they are reset by the user or returned to their first position automatically.

Active/automatic training equipment is also known. For example, US Patent Publication 2020/0215403 to Abi Nader relates to an interactive hitting pad for a martial arts trainer, which includes a base; a hitting pad platform having a hitting pad; and a plurality of linear actuators, wherein each of the linear actuators includes a first end and a second end, and wherein the first end of each of the linear actuators is articulatably connected to the base, and wherein the second end of each of the linear actuators is articulatably connected to the hitting pad platform, to form a parallel manipulator. A control system is connected to the plurality of linear actuators adapted to control the position and orientation of the hitting pad platform, and one or more sensors are operatively connected to the hitting pad platform and in communication with the control system for sensing impacts to the hitting pad by a user. A martial arts training system using the interactive hitting pad, as well as a method of training, are also provided.

BRIEF SUMMARY OF EMBODIMENTS OF THE INVENTION

Regarding passive training systems, these systems do not account for variances in the response time, speed, force, and timing of hits on the various hitting pads. Passive training systems usually are unable to cover the wide range of different level athletes where faster speeds and response times are needed to train.

Regarding active/automatic training equipment, the inventor of the present invention has found that the invention of US Patent Publication 2020/0215403 lacks in many areas, as it does not account for users of different heights, and the location of the sensor causes the sensor to be exposed to multiple strikes and therefore prone to breaking.

Therefore, an aspect of some embodiments of the present invention refers to a training system for martial arts training, comprising: (a) a vertical primary support frame configured to be fixed to a ground; (b) a secondary frame slidable vertically on the primary support frame and lockable on the primary support frame at a desired height; (c) a plurality of linear actuators joined to the secondary frame, each of the linear actuators having an end configured to extend and retract; (d) a plurality of hitting pads, each of the hitting pads being joined to the end of a respective one of the linear actuators; (e) a control apparatus connected to the plurality of linear actuators and configured to control a position of the end of each linear actuator, thereby controlling the position of the hitting pads; (f) a plurality of sensors operatively connected to respective linear actuators and in communication with the control apparatus, the sensors being for sensing impacts to respective hitting pads.

In a variant, the training system comprises a back support frame having a section joined to the primary support frame, and a section extending behind the primary support frame and configured to be fixed to the ground.

In another variant, the training system comprises a back support frame having a section joined to the primary support frame, and a section extending behind the primary support frame and configured to be fixed to a wall.

In yet another variant, the training system comprises at least one vertical linear actuator configured to move the secondary frame along the primary support frame.

In a further variant, the training system comprises a user interface configured to receive from a user instructions relating to a sequence for controlling the positions of the hitting pads.

In yet a further variant, the control apparatus comprises a communication unit configured to communicate with an external communication device to receive from the external communication device instructions relating to a sequence for controlling the positions of the hitting pads.

In variant, the control apparatus is in communication with the sensors and is configured to receive sensor data and to process the sensor data to generate training data indicative of timing and force of the impacts to the hitting pads.

In another variant, the training system comprises a user interface configured to receive and display the training data.

In yet another variant, the control apparatus comprises a communication unit configured to communicate with an external communication device to send the training data to the external communication device for display.

In some embodiments of the present invention, at least one of the linear actuators comprises a double acting pneumatic cylinder comprising a chamber, a piston, and a shaft. The chamber surrounds a cavity and extending and having a proximal side and a distal side, the chamber having a proximal port at or near the proximal side and distal port at or near the distal side, the proximal and distal ports being in fluid communication with the cavity and with an external environment outside the chamber. The piston is located inside the cavity and configured to move linearly in the cavity between the proximal side and the distal side, the piston being configured to prevent fluid communication between a section of the cavity proximal to the piston and a section of the cavity distal to the piston. The shaft extends from the piston to a proximal side of the chamber and out of the proximal side of the chamber, the shaft having a proximal edge forming the end of the linear actuator joined to the hitting pad.

In a variant, the training device comprises a valve apparatus which comprises: a proximal connection pipe joined to the proximal port; a proximal equalization pipe in fluid communication with the proximal connection pipe; a distal connection pipe joined to the distal port; a distal equalization pipe in fluid communication with the distal connection pipe. The sensor is configured to measure fluid flow in the proximal equalization pipe and/or the distal equalization pipe and generate fluid flow data in real time. The control apparatus is configured to receive fluid flow data from the sensor and process the fluid flow data in real time to detect an impact event and to indicate a strength of the impact.

In another variant, the valve apparatus further comprises: a reservoir of compressed fluid; a proximal reservoir pipe in fluid communication with the proximal connection pipe and with the reservoir; a proximal valve device configured to control fluid passage from the reservoir to the chamber's cavity via the proximal reservoir pipe, and between the chamber's cavity and the external environment via the proximal equalization pipe, the proximal valve device being controlled by the control apparatus; a distal reservoir pipe in fluid communication with the distal connection pipe and with the reservoir; a distal valve device configured to control fluid passage from the reservoir to the chamber's cavity via the distal reservoir pipe, and between the chamber's cavity and the external environment via the distal equalization pipe, the distal valve device being controlled by the control apparatus.

In yet another variant, the training system comprises an electric motor configured to move the hitting pad, wherein the control unit is configured to control the electrical motor to control the position of the hitting pad.

Another aspect of some embodiments of the present invention relates to a training system for martial arts training, the system comprising: a plurality of linear actuators, each of the linear actuators having an end configured to extend and retract; a plurality of hitting pads, each of the hitting pads being joined to the end of a respective one of the linear actuators; a control apparatus connected to the plurality of linear actuators and configured to control a position of the end of each linear actuator, thereby controlling the position of the hitting pads; a plurality of sensors operatively connected to respective linear actuators and in communication with the control apparatus, the sensors being for sensing impacts to respective hitting pads. Each one of the linear actuators comprises a double acting pneumatic cylinder comprising a chamber, a piston, and a shaft. The chamber surrounds a cavity and has a proximal side and a distal side, the chamber having a proximal port at or near the proximal side and distal port at or near the distal side, the proximal and distal ports being in fluid communication with the cavity and with an external environment outside the chamber. The piston is located inside the cavity and configured to move linearly in the cavity between the proximal side and the distal side, the piston being configured to prevent fluid communication between a section of the cavity proximal to the piston and a section of the cavity distal to the piston. The shaft extends from the piston to a proximal side of the chamber and out of the proximal side of the chamber, the shaft having a proximal edge forming the end of the linear actuator joined to the hitting pad. The training system comprises a valve apparatus which comprises, for each linear actuator: a proximal connection pipe joined to the proximal port; a proximal equalization pipe in fluid communication with the proximal connection pipe; a distal connection pipe joined to the distal port; a distal equalization pipe in fluid communication with the distal connection pipe. Each sensor is configured to measure fluid flow in the proximal equalization pipe and/or the distal equalization pipe and generate fluid flow data in real time. The control apparatus is configured to receive fluid flow data from the sensor and process the fluid flow data in real time to detect an impact event and to indicate a strength of the impact.

In a variant, the valve apparatus further comprises a reservoir of compressed fluid and, for each linear actuator: a proximal reservoir pipe in fluid communication with the proximal connection pipe and with the reservoir; a proximal valve device configured to control fluid passage from the reservoir to the chamber's cavity via the proximal reservoir pipe, and between the chamber's cavity and the external environment via the proximal equalization pipe, the proximal valve device being controlled by the control apparatus; a distal reservoir pipe in fluid communication with the distal connection pipe and with the reservoir; a distal valve device configured to control fluid passage from the reservoir to the chamber's cavity via the distal reservoir pipe, and between the chamber's cavity and the external environment via the distal equalization pipe, the distal valve device being controlled by the control apparatus.

In another variant, the training system comprising an electric motor configured to move the hitting pad, wherein the control unit is configured to control the electrical motor to control the position of the hitting pad.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
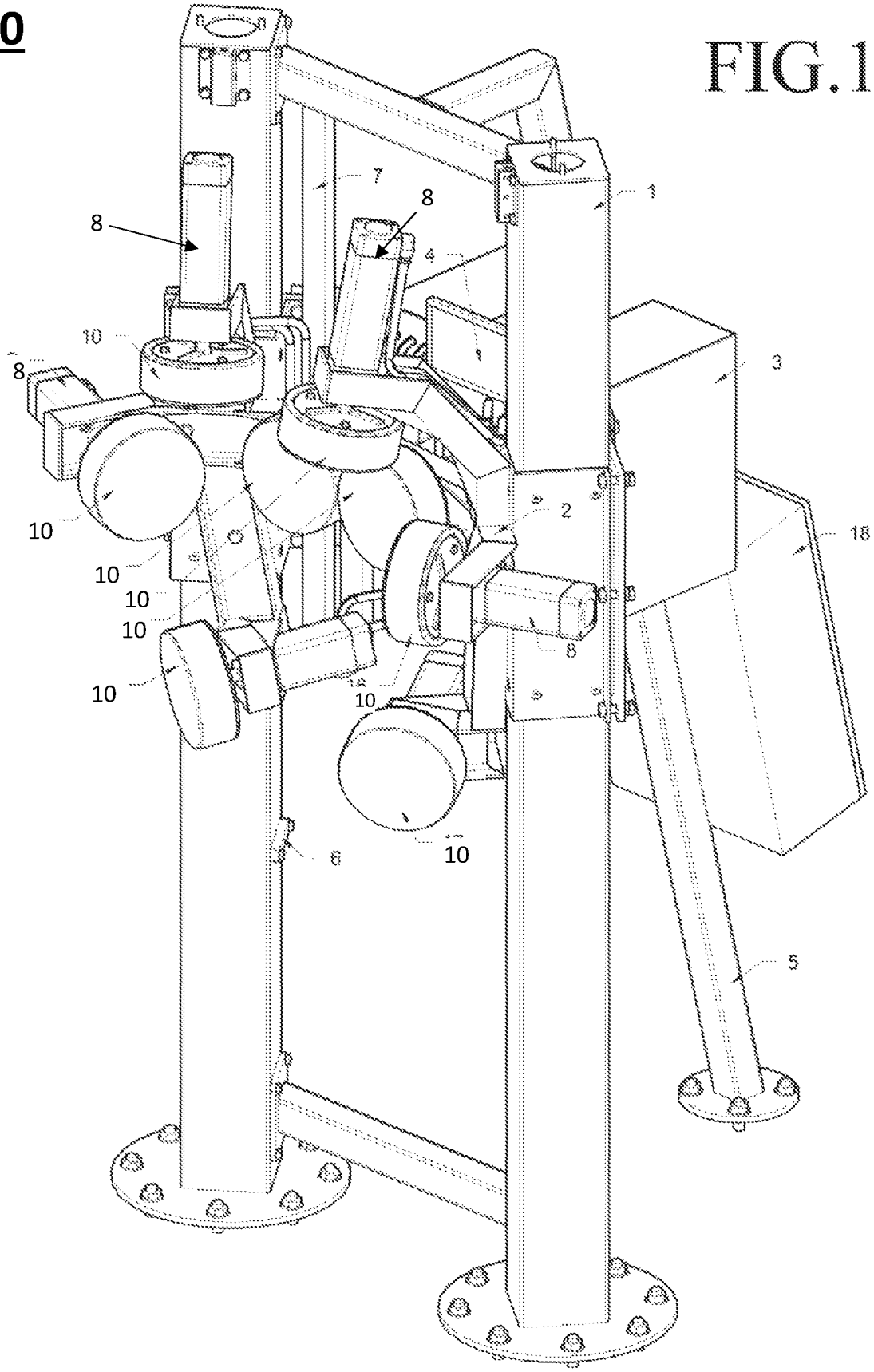
FIG. 1 is an isometric view of a training system having multiple hitting pads, according to some embodiments of the present invention.
Figure 2:
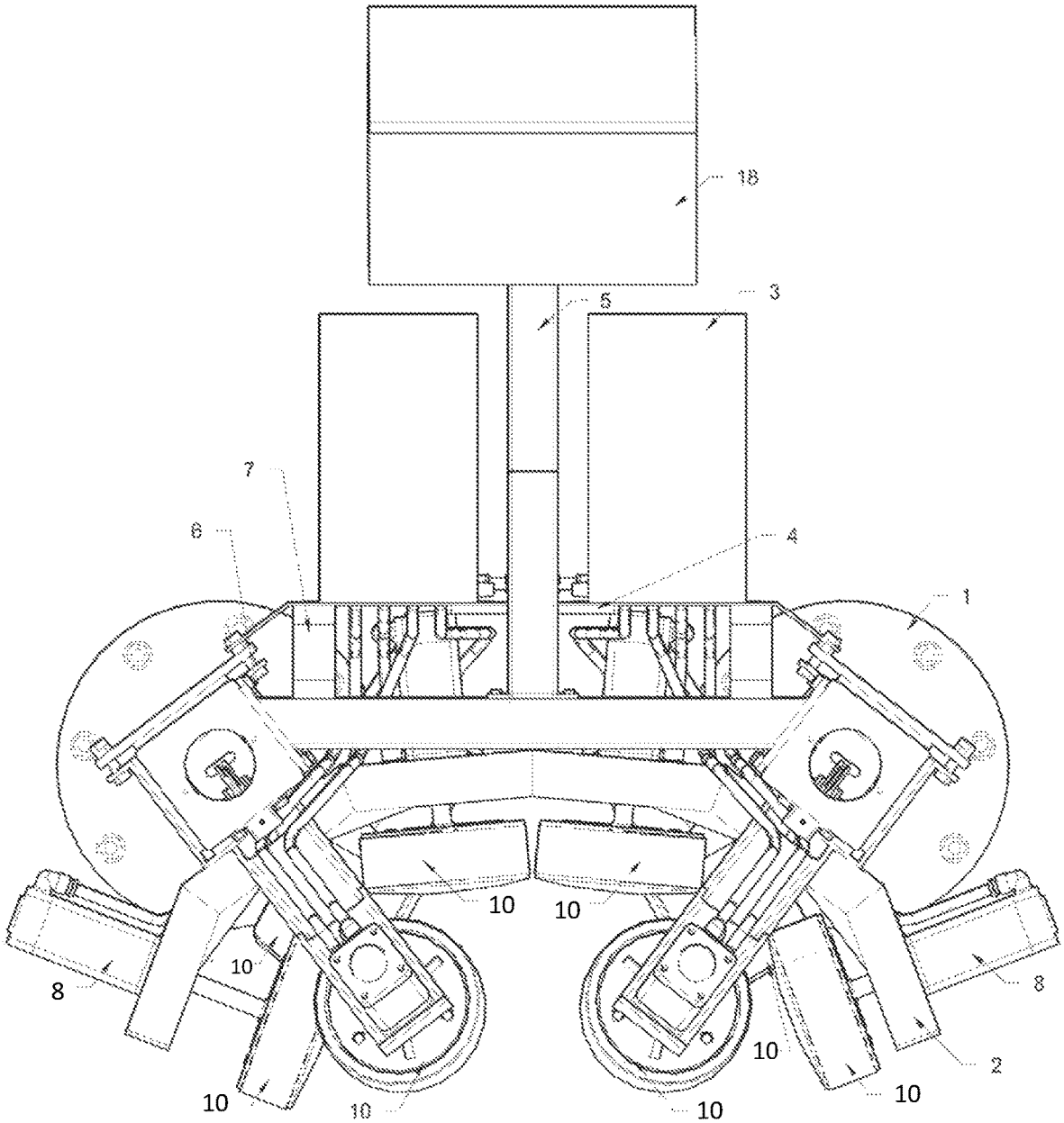
FIG. 2 is a top view of the training system of FIG. 1.
Figure 3:
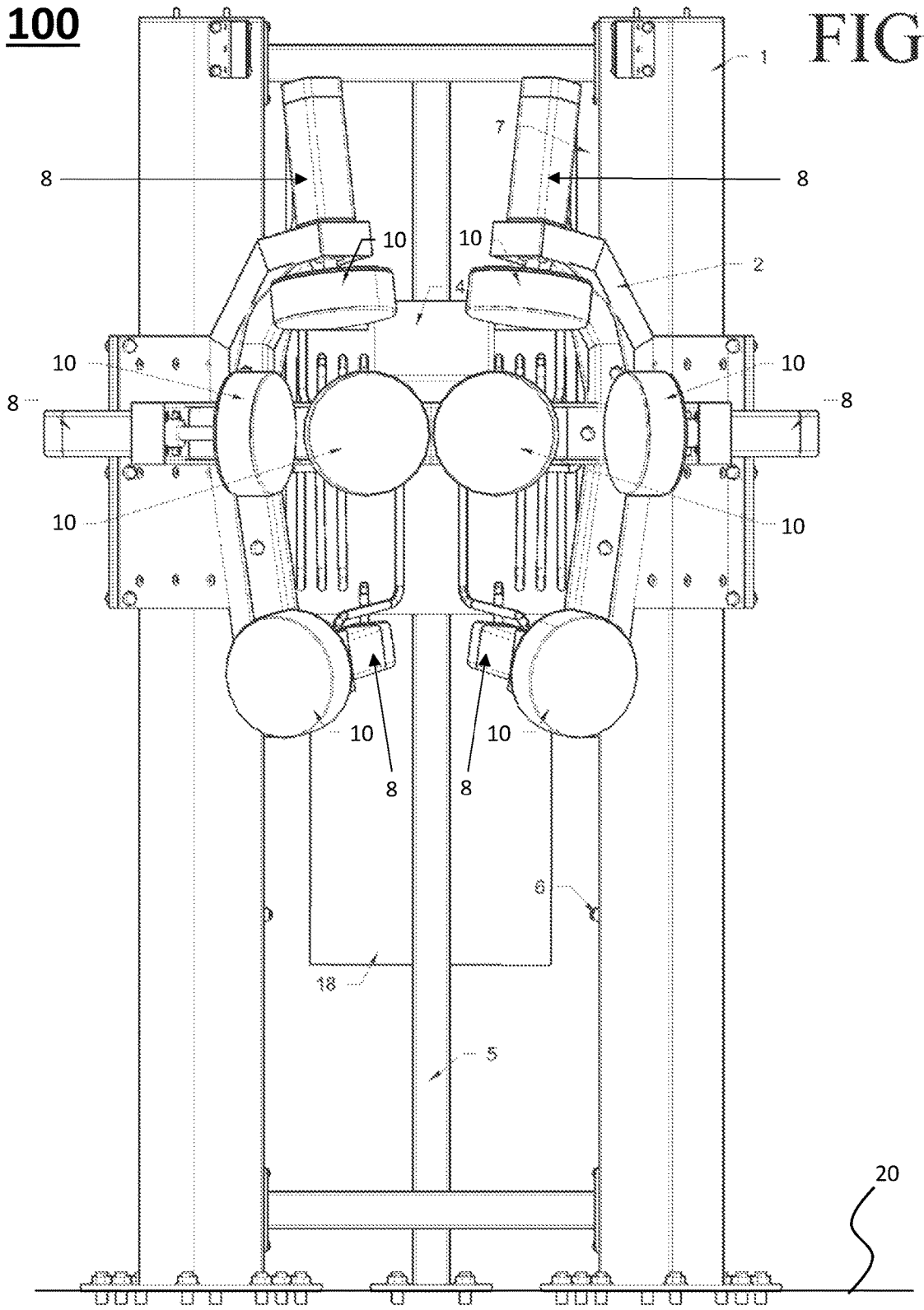
FIG. 3 is a front view of the training system of FIG. 1.
Figure 4:
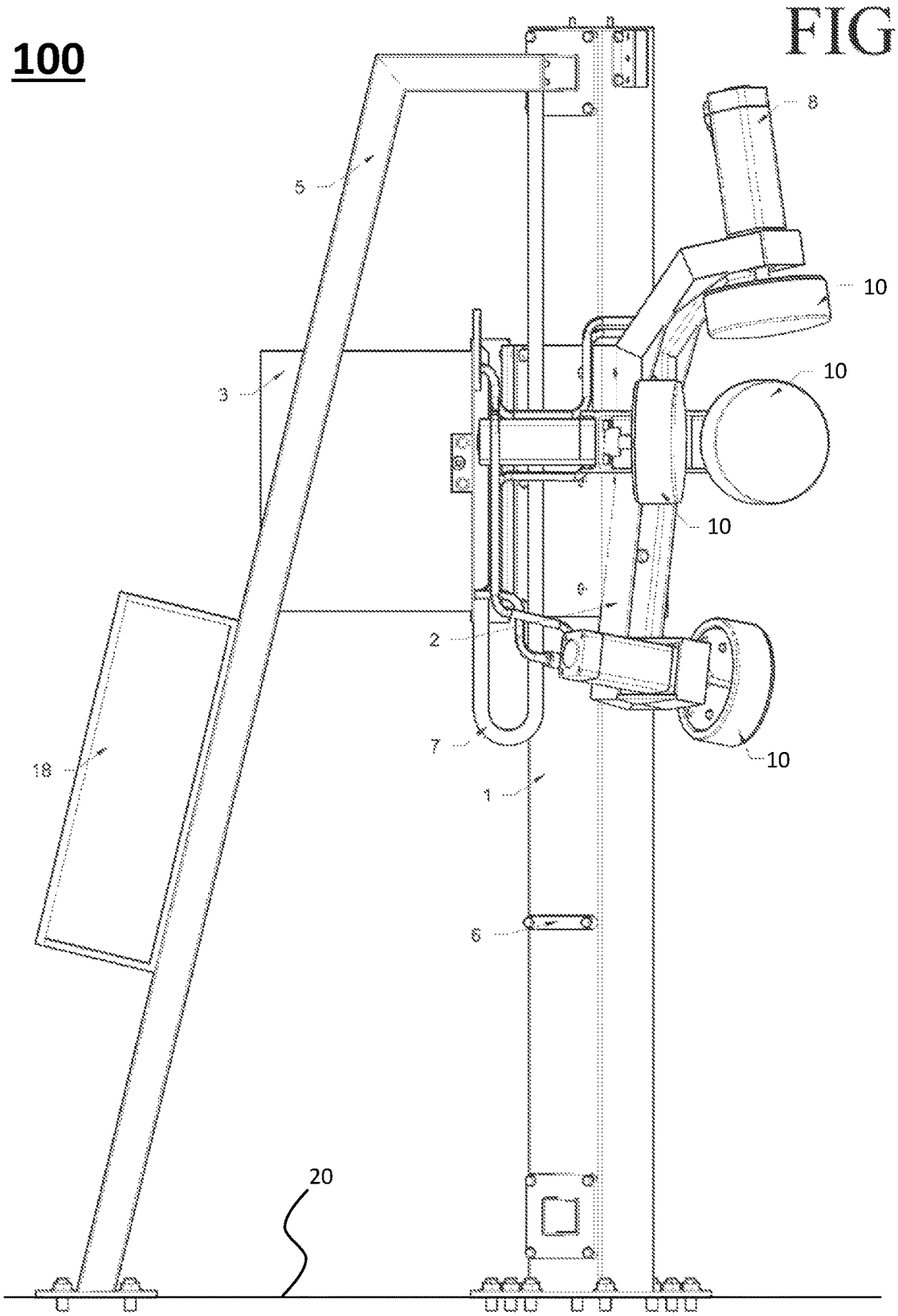
FIG. 4 is a half-way side sectional view of the training system of FIG. 1.
Figure 5:
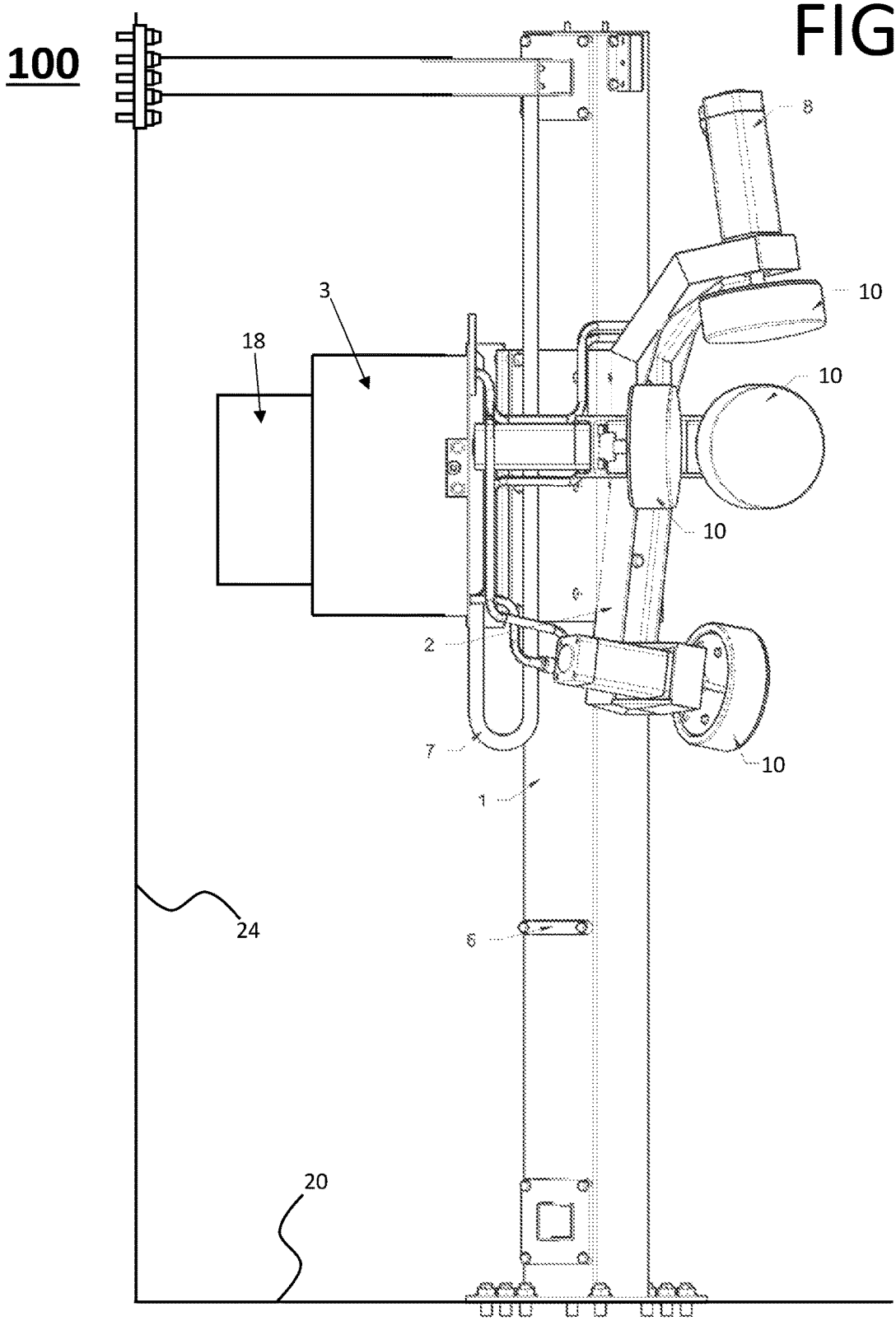
FIG. 5 is a half-way side sectional view of a training system having a back support frame configured to be joined to a wall, according to some embodiments of the present invention.
Figure 6:
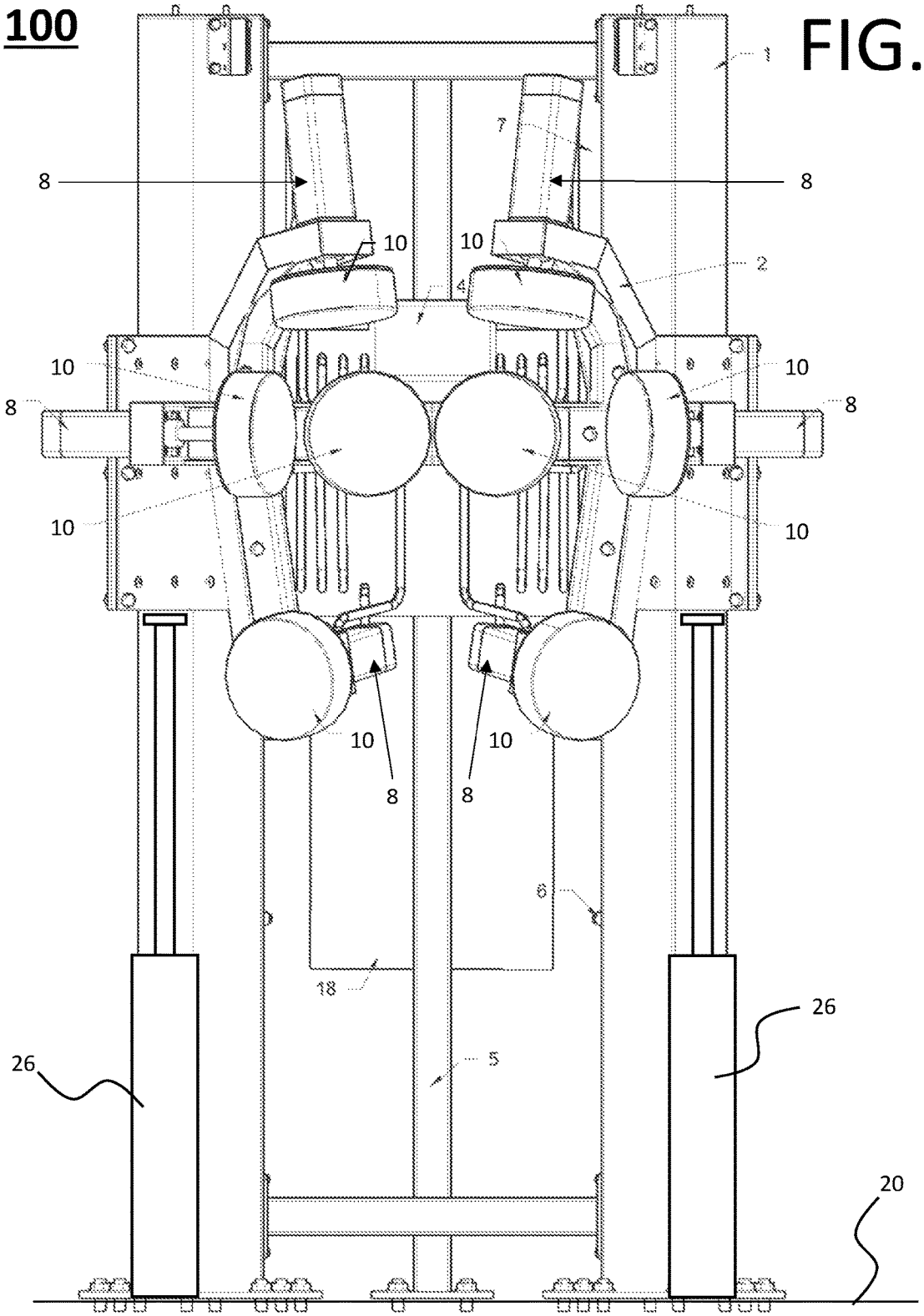
FIG. 6 is a half-way side sectional view of a training system with one or more linear actuators controlling the height of the secondary frame, according to some embodiments of the present invention.

Referring now to the drawings, FIG. 1 is an isometric view of a training system 100 having multiple hitting pads, according to some embodiments of the present invention. FIG. 2 is a top view of the training system of FIG. 1. FIG. 3 is a front view of the training system of FIG. 1. FIG. 4 is a half-way side sectional view of the training system of FIG. 1. FIG. 5 is a half-way side sectional view of a training system having a back support frame configured to be joined to a wall, according to some embodiments of the present invention. FIG. 6 is a half-way side sectional view of a training system with one or more linear actuators controlling the height of the secondary frame, according to some embodiments of the present invention;

The martial arts training system 100 includes a vertical primary support frame 1, a secondary frame 2, a plurality of linear actuators 8, a plurality of hitting pads 10, a control apparatus 18, and a plurality of sensors.

The primary support frame is configured to be fixed to a ground 20. The secondary frame 2 is slidable vertically on the primary support frame 1 and lockable on the primary support frame 1 at a desired height. The plurality of linear actuators 8 are joined to the secondary frame. Each of the linear actuators has an end configured to extend and retract. Each of the hitting pads 10 is joined to the end of a respective linear actuator 8.

The control apparatus 18 is connected to the plurality of linear actuators and configured to control a position of the end of each linear actuator. In this manner, the control apparatus 18 controls the position of the hitting pads 10.

The sensors 22 (shown, for example, in FIGS. 9-15) are operatively connected to respective linear actuators 8 and in communication with the control apparatus 18. The sensors 22 are configured to sense environmental characteristic indicative of impacts to respective hitting pads 10. The sensors may include, for example, accelerometer joined to the moving portions of the linear actuators 8, or force sensors joined to the hitting pads 10, or fluid flow/pressure sensors measuring fluid flow/pressure into and/or out of the respective linear actuators, as will be described below with reference to FIGS. 9-15.

In some embodiments of the present invention, the training system 100 includes a back support frame 5. In some embodiments of the present invention, the back support 5 has a section joined to the primary support frame 1, and a section extending behind the primary support frame 1 and configured to be fixed to the ground 20. The back support frame 5 may be inclined backwards from the primary support frame 1 and fixed to the ground 20. This creates a tetrahedral shape which is a very robust design capable of enduring heavy strikes with very little distortions.

Alternatively, if there is a sturdy wall directly behind the training system 100, the back support frame 5 a back support frame having a section joined to the primary support frame 1, and a section extending behind the primary support frame 1 and configured to be fixed to a wall 24, as shown in the example of FIG. 5.

The secondary frame 2 is slidable slide vertically along the primary base 1. The secondary frame 2 can be manually unlocked, changed to the appropriate height and can be locked back in place.

The height, at which the secondary frame 2 is locked, is chosen in accordance with the trainee's height. To prevent the secondary frame 2, when unlocked, from falling and damaging sensitive equipment, a physical stop 6 may be fixed on the primary support frame 1 in the trajectory of the secondary frame 2.

The secondary frame 2 may be moved manually by a user or automatically. If the secondary frame is moved automatically, one or more second linear actuators 26 can be used to move the secondary frame 2 vertically upwards or downwards and lock the secondary frame 2 in place at a desired height, as seen in the example of FIG. 6. The second linear actuator(s) 26 may be electric, pneumatic, or hydraulic actuates(s). The second linear actuator(s) 26 may have a distance sensing component which can send data regarding the height of the secondary frame 2 to the control apparatus 18. The height can be either manually chosen through the user interface 4 which (which is connected to the control apparatus 18 as will be discussed further below) or through a communication device (e.g., smartphone, tablet, laptop, etc.) associated with an already registered user and having a pre-defined height for the user. As will be discussed below the communication device may be in wired or wireless communication with the control apparatus 18 and can be used by the user to instruct the control apparatus to move the secondary frame 2 to a desired height.

The hitting pads 10 installed on the linear actuators 8 are positioned at certain heights and angles so that a certain type of punch is simulated when the hitting pads 10 are extended. For example, one hitting pad 10 is used to simulate a "Right Upper-cut" punch, another hitting pad 10 14 is used to simulate a "Left Upper-cut" punch, yet another hitting pad 10 is used to simulate "Right Hook" punch, a further hitting pad 10 is used to simulate "Left Hook" punch, yet a further hitting pad 10 is used to simulate "Jab" punch, one hitting pad 10 is used to simulate "Cross" punch, another hitting pad 10 is used to simulate "Left Body Shot", and a final hitting pad 10 is used to simulate "Right Body Shot".

The linear actuators 8 with the hitting pads 10 are fixed on the secondary frame 2 and in turn are oriented at the predetermined angles. The angles and orientation of the structure of the secondary frame 2 are very critical and, for each linear actuator 8, there is a specific angle and orientation for each specific punch type.

In some embodiments of the present invention, the user interface 4 notifies the user on which punch is to be hit and displays to the user training data and information, such as the time remaining of the session, strength of punches delivered, speed and response time between punches.

In some embodiments of the present invention, a cable chain 7 is used to transfer the cables carrying power, signals to the valves in the valve apparatus 3, the graphical interface 4, signals from the sensing components on the linear actuators 8, signals from the sensors (such as reed switches mentioned further below) in valve system 3. All electrical cables passing through primary support frame 1 and vertically sliding secondary frame 2 are passed through the two cable chains 7 (one at each side).

In some embodiments of the present invention, the control apparatus 18 is positioned in any convenient location such, as on the back support 5 frame.

Figure 7:
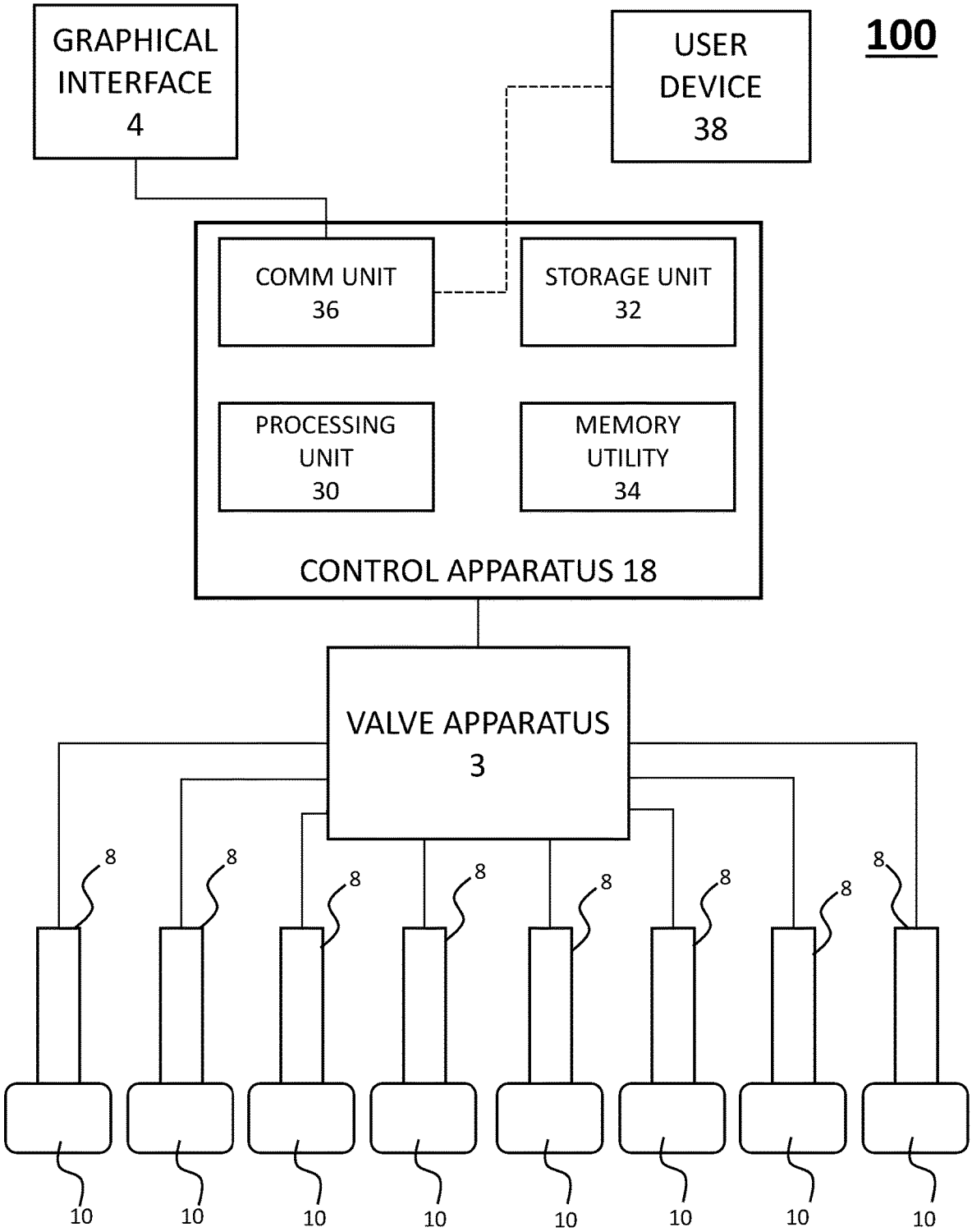
FIG. 7 is a block diagram illustrating the control of the hitting pads of the training system of FIG. 1, according to some embodiments of the present invention.

FIG. 7 is a block diagram illustrating the control of the hitting pads of the training system 100 of FIG. 1, according to some embodiments of the present invention.

In some embodiments of the present invention, the training system 100 includes a plurality of linear actuators 8 as described above, a plurality of hitting pads as described above, a control apparatus 18, a valve apparatus 3, and optionally a graphical interface 4.

The control apparatus 18 includes a processing unit 30, a non-volatile data storage unit 32, a volatile memory utility 34, and a communication unit 36.

In some embodiments of the present invention, the control apparatus 18 controls the plurality of the pneumatically or hydraulically powered linear actuators 8 through a collection of valves in the valve apparatus 3. The control apparatus 18 is designed and programmed to control the valve apparatus 3 to retract or extend the linear actuators 8 in one or more predetermined sequences as explained below. The programming/instructions to control the valve apparatus 3 may be stored in the storage unit 32 and transferred to the processing unit 30 for executing them via the volatile memory utility 34. Optionally or alternatively, the programming/instructions to control the valve apparatus 3 may be transferred to the volatile memory utility 34 and to the processing unit 30 from a user communication device 38 (e.g. smartphone, tablet, etc.) which communicates with the control apparatus 18 by wire or wirelessly via the communication unit 36.

The user device 38 and graphical interface 4 may be used by the user to select a training program (for example, a sequence in which hitting pads 10 are extended and retracted), and optionally a height of the second frame. The control apparatus 18 may transmit to the graphical interface 4 and/or the user device 38 data indicative of training parameters (e.g. impact strength and reaction time, as will be explained below), and the graphical interface 4 and/or the user device 38 are configured for displaying values of the training parameters.

The valve apparatus 3 may include pressure/flow sensors to measure pressure/flow of a fluid into and/or out of the respective linear actuators and create pressure/flow data that is analyzed by the processing unit 30 of control apparatus to detect an impact event on the hitting pads 10, and to calculate a strength of the impact. For example, an impact may be identified after a linear actuator 8 is extended and when flow/pressure of air leaving and/or entering the linear actuator 8 is above a predetermined threshold.

In some embodiments of the present invention, sensing components, such as reed switches, are installed on the linear actuators 8, which send information about the positions of each linear actuators 8 to the processing unit 30 of the control apparatus 18. In some embodiments of the present invention the processing unit 30 of the control apparatus 18 is designed to always have seven linear actuators 8 retracted and only one linear actuator 8 extended and ready to receive an impact (punch or kick). The linear actuator 8 is pushed back by the impact, prompting any of the other seven linear actuators 8 to be pushed forward. At the same time, the processing unit 30 of the control apparatus 18 calculates the strength of the impact by receiving the flow/pressure data from sensors in the valve apparatus. When the impact ends, the processing unit 30 of the control apparatus 18 controls the linear actuator 8 to retract.

The valve system 3 includes a pressure/flow sensor, connected to each linear actuator 8, to measure the pressure/flow created by each impact, and ids designed to transmit the pressure/flow data to the control apparatus 18. The processing unit 30 of the control system 18 uses the pressure/flow data to calculate the strength of the impact. A value of the impact strength may be displayed on the graphical interface 4 and/or in the user communication device 38. The control apparatus 18 may also measure the time between extending each linear actuator 8 and detecting the impact, therefore measuring the reaction time of the user for each impact. The reaction time may also be displayed on graphical interface 4 and/or on the user communication device 38.

The impact strength and the reaction times are training parameters that may be stored in the storage unit 32 or a storage unit of the user device 38, or in a remote server. The stored training parameters may be processed and compared to the user's previous training parameters to track the user's progress in training. A website or application may be used by the user to view and track the user's training parameters and to track the user's progress.

The control apparatus 18 may store in the storage unit a pre-programmed sequence of punches which the user will have to finish in a set amount of time. The sequence of punches can be focused more on strength training or on technique and hitting combination of punches consecutively.

As explained above, the plurality of linear actuators 8 are controlled by the processing unit 36 of the control apparatus 18. The processing unit 36 may include a microcontroller for operating, controlling, and programming the system. The control apparatus 18 has a communication unit 36 to connect to remote electronic devices (user communication devices 38), such as smart phones and other mobile device, via Bluetooth, Wi-Fi, or other wired or wireless protocols. The connectivity to smart devices allows the user training on the unit as well as his/her supervising coach, to monitor the power, speed and time on target of each hit on the hitting pads 10. It will also allow the monitoring of the person's response time to hit and the time difference between hits. The user communication device 38 and/or graphical interface can also be used to change operational parameters of the control system 18.

Figure 8:
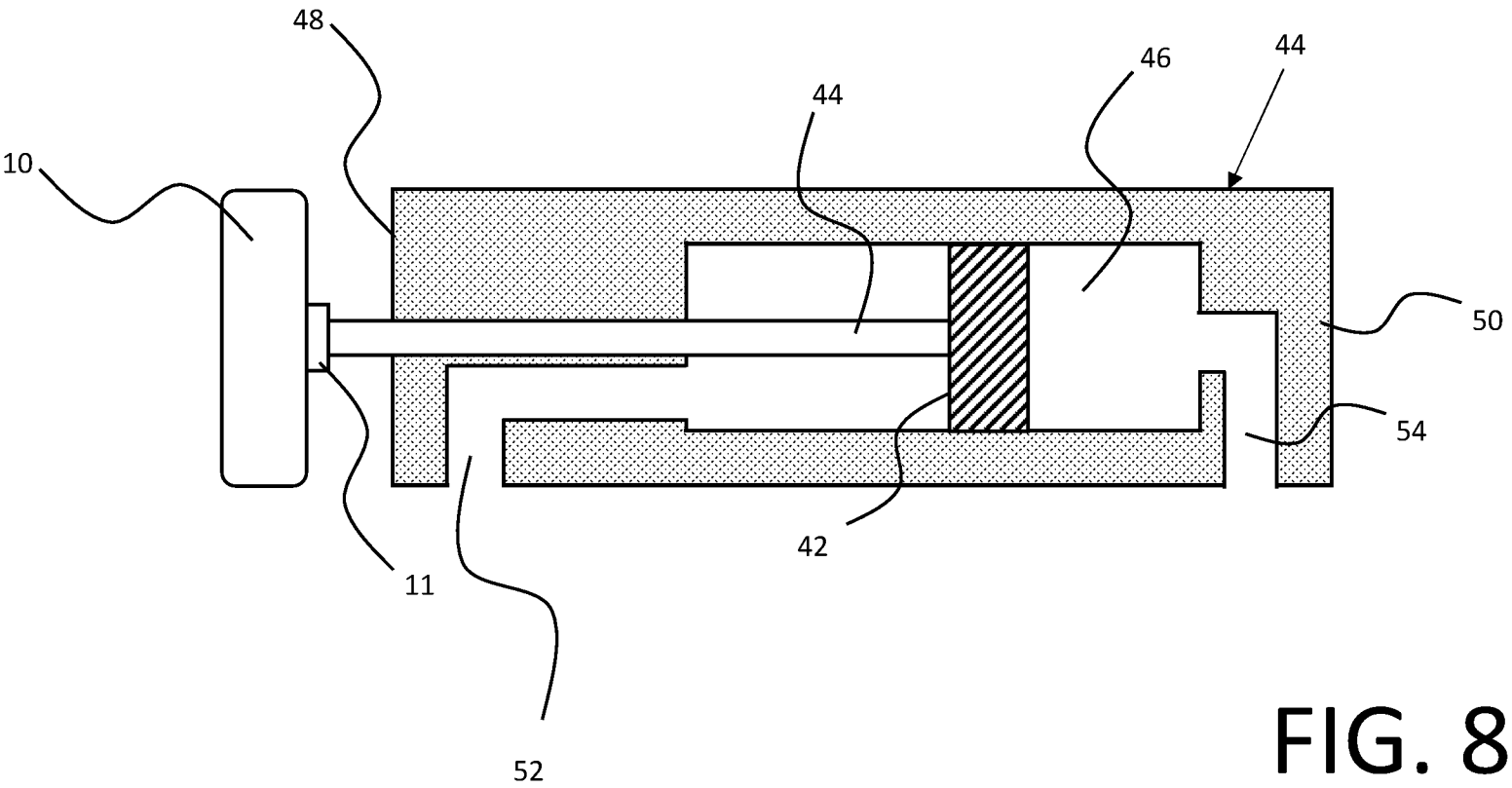
FIG. 8 is a side cross sectional view of a linear actuator used in the training system, according to some embodiments of the present invention.

The present invention is remote controlled via wireless technologies (WLAN, Bluetooth, NFC, GSM, 3G, 4G, 5G etc. . . . ) in order to allow the below interactions:

FIG. 8 is a side cross sectional view of a linear actuator 8 used in the training system 100, according to some embodiments of the present invention. The linear actuator 8 includes a chamber 40, a piston 42, and a shaft 44.

The chamber 44 surrounds a cavity 46 and has a proximal side 48 and a distal side 50. The chamber having a proximal port 52 at or near the proximal side 48 and distal port 54 at or near the distal side 50. The ports 52 and 54 are in fluid communication with the cavity 46 and with an external environment outside the chamber.

The piston 42 is located inside the cavity 46 and configured to move linearly in the cavity 46 between the proximal side 48 and the distal side 50. The piston is configured to prevent fluid communication between a section of the cavity 46 that extends between the piston 42 the proximal side 48 and a section of the cavity 46 that extends between the piston 42 the distal side 50.

The shaft 44 extends from the piston 42 to the proximal side 48 of the chamber and out of the proximal side 48 of the chamber. The shaft has a proximal edge 11 forming the end of the linear actuator that joined to the hitting pad 10.

Figure 15:
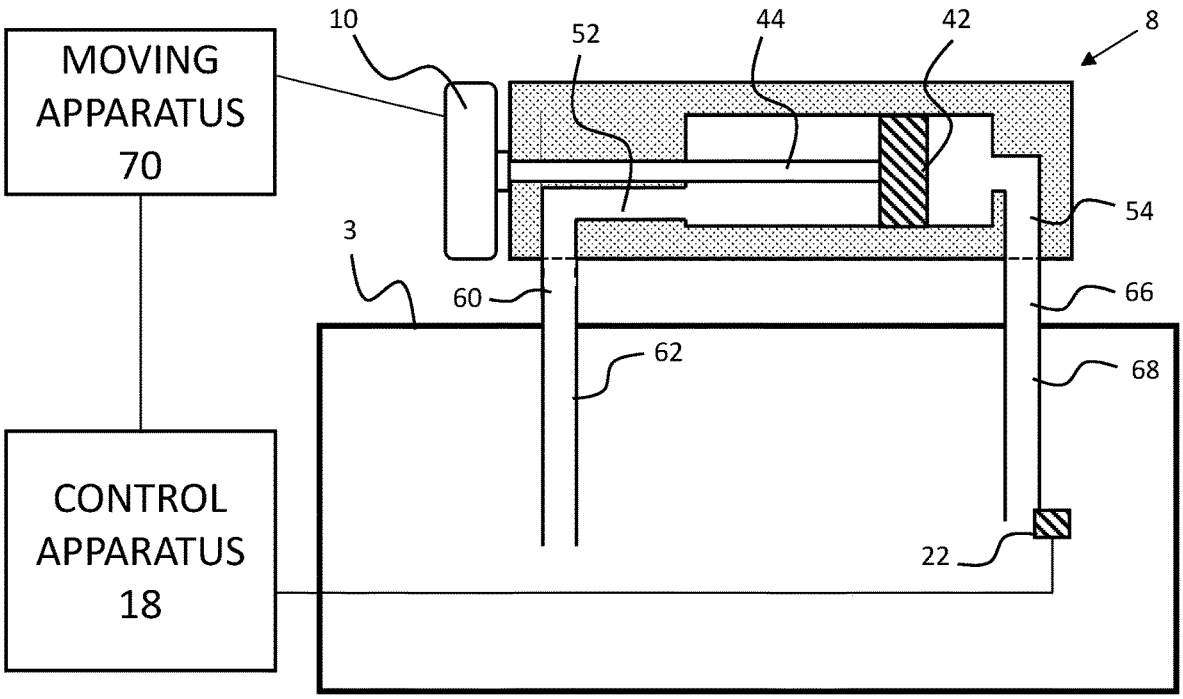
FIG. 15 illustrates a linear actuator controlled via a moving, according to some embodiments of the present invention.

FIG. 15 illustrates a linear actuator 8 controlled via a moving apparatus, according to some embodiments of the present invention.

The linear actuator 8 is connected to the valve apparatus 3, which includes a proximal connection pipe 60, a proximal equalization pipe 62, a distal connection pipe 66, and a distal equalization pipe 68. The proximal connection pipe 60 is joined to the proximal port 52. The proximal equalization pipe 62 is in fluid communication with the proximal connection pipe and an external environment outside the chamber of the linear actuator. The distal connection pipe 66 is joined to the distal port. The distal equalization pipe 68 is in fluid communication with the distal connection pipe 66 and the external environment outside the chamber of the linear actuator.

When the user hits the hitting pad 10, the hitting pad moves pushes the shaft 44 and the piston 42, causing fluid to flow into the cavity via the proximal equalization pipe 62 and to exit the cavity via the distal equalization pipe 68. The pressure/flow of the fluid flowing into the proximal equalization pipe 62 and/or the pressure/flow of the fluid flowing out of the distant equalization pipe 68 are indicative of the force of the impact between the user and the hitting pad and can be used for calculating the force of the impact.

The sensor pressure/flow sensor 22 is configured to measure fluid flow/pressure in the proximal equalization pipe 62 and/or the distal equalization pipe 68 and generate fluid flow/pressure data in real time. The control apparatus 18 is configured to receive fluid flow/pressure data from the sensor 22 and process the fluid flow/pressure data in real time to detect an impact event, as explained above.

The moving apparatus 70 is configured to move the hitting pad 10, shaft 44, and piston 42, so the hitting pad 10 is retracted against the chamber of the linear actuator 8 or extended and ready to be hit.

The moving apparatus 70 may be an electric motor, for example. As will be explained below, the moving apparatus may include valves and pressurized fluid contained in the valve apparatus 3 and configured to move the hitting pad between a retracted and extended configuration via fluid flow into and out of the cavity of the linear actuator 8.

An advantage of sensing the impact via a flow/pressure sensor 22 lies in the fact that the sensor 22 is away from the location of the impact and is therefore less prone to breakage due to the impact. Also, the sensor 22 can be easily replaced if needed, without having to remove the hitting pad 10.

In the example of FIG. 15, the sensor 22 is located near or at the opening of the distal equalization pipe 68 to measure the flow/pressure of fluid exiting the cavity as a result of the impact. Alternatively, the sensor 22 is located near or at the opening of the proximal equalization pipe 62 to measure the flow/pressure of fluid entering the cavity as a result of the impact. In a variant, two sensors 22 present: one located near or at the opening of the distal equalization pipe 68 to measure the flow/pressure of fluid exiting the cavity as a result of the impact, and one located near or at the opening of the proximal equalization pipe 62 to measure the flow/pressure of fluid entering the cavity as a result of the impact.

FIGS. 9-12 illustrate different stages of the operation of a pneumatic linear actuator via four two-way valves, according to some embodiments of the present invention.

In the example of FIGS. 9-12, the valve apparatus 3 further includes a reservoir of compressed fluid 80, a proximal reservoir pipe 82, a proximal valve device 84, a distal reservoir pipe 86, and a distal valve device 88.

In the example of FIGS. 9-12, the reservoir of compressed fluid 80 is a reservoir of compressed air. The proximal reservoir pipe 82 is in fluid communication with the proximal connection pipe 60 and with the reservoir 80. The proximal valve device is configured to control air passage from the reservoir 80 to the chamber's cavity via the proximal reservoir pipe 82, and between the chamber's cavity 46 and the external environment via the proximal equalization pipe 62. The proximal valve device 84 is controlled by the control apparatus 18. In the example of FIGS. 9-12, the proximal valve device 84 includes a first proximal two-way valve 84*a* and a second proximal two-way valve 84*b*. The first proximal two-way valve 84*a* is configured for regulating air passage via the proximal equalization pipe 62, while the second proximal two-way valve 84*b* is configured for regulating air passage via the proximal reservoir pipe 82.

The distal reservoir pipe 86 is in fluid communication with the distal connection pipe 66 and with the reservoir 80. The distal valve device 88 is configured to control fluid passage from the reservoir 80 to the chamber's cavity 46 via the distal reservoir pipe 86, and between the chamber's cavity 46 and the external environment via the distal equalization pipe 68. The distal valve device 88 is controlled by the control apparatus 18. In the example of FIGS. 9-12, the distal valve device 88 includes a first distal two-way valve 88*a* and a second distal two-way valve 88*b*. The first distal two-way valve 88*a* is configured for regulating air passage via the distal equalization pipe 68, while the second distal two-way valve 88*b* is configured for regulating air passage via the distal reservoir pipe 86.

Figure 9:
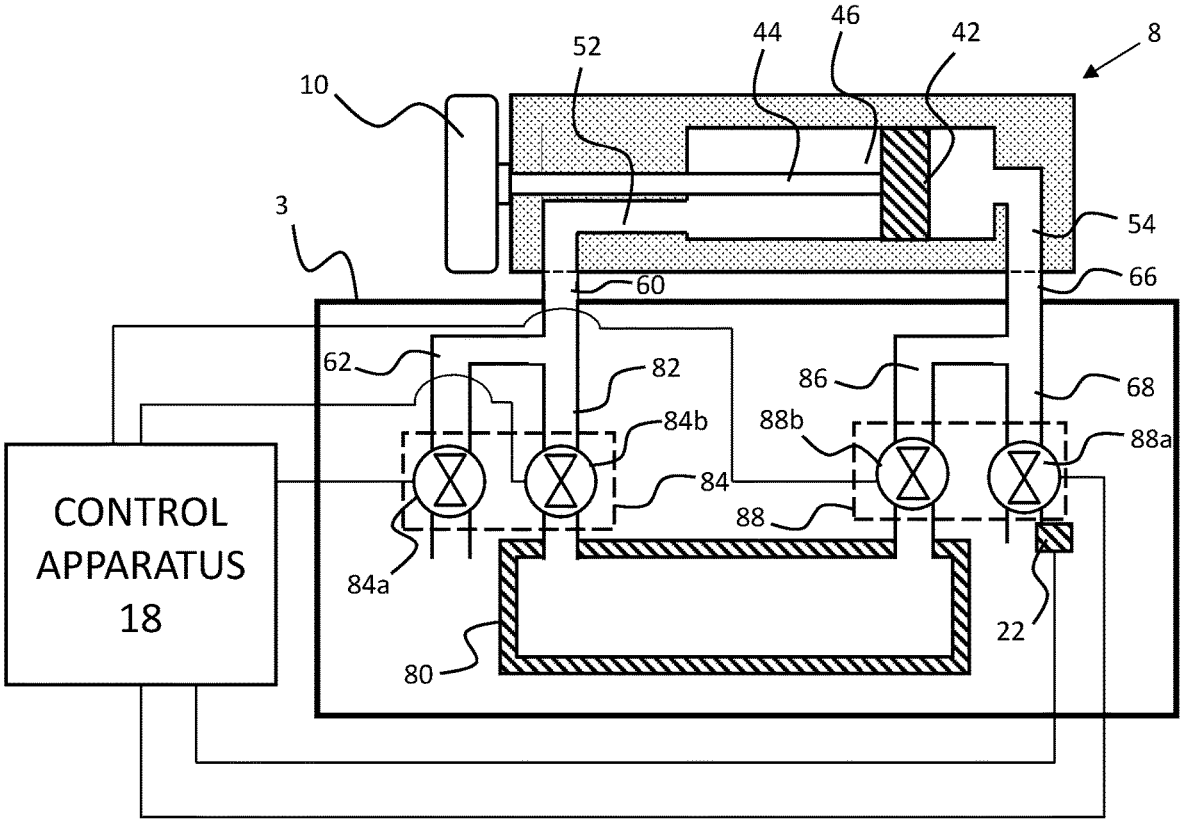
FIGS. 9-12 illustrate different stages of the operation of a pneumatic linear actuator via four two-way valves, according to some embodiments of the present invention.

In FIG. 9, the linear actuator 8 is in a retracted mode, in which the hitting pad 10 is retracted against the proximal side of the chamber of the actuator.

Figure 10:
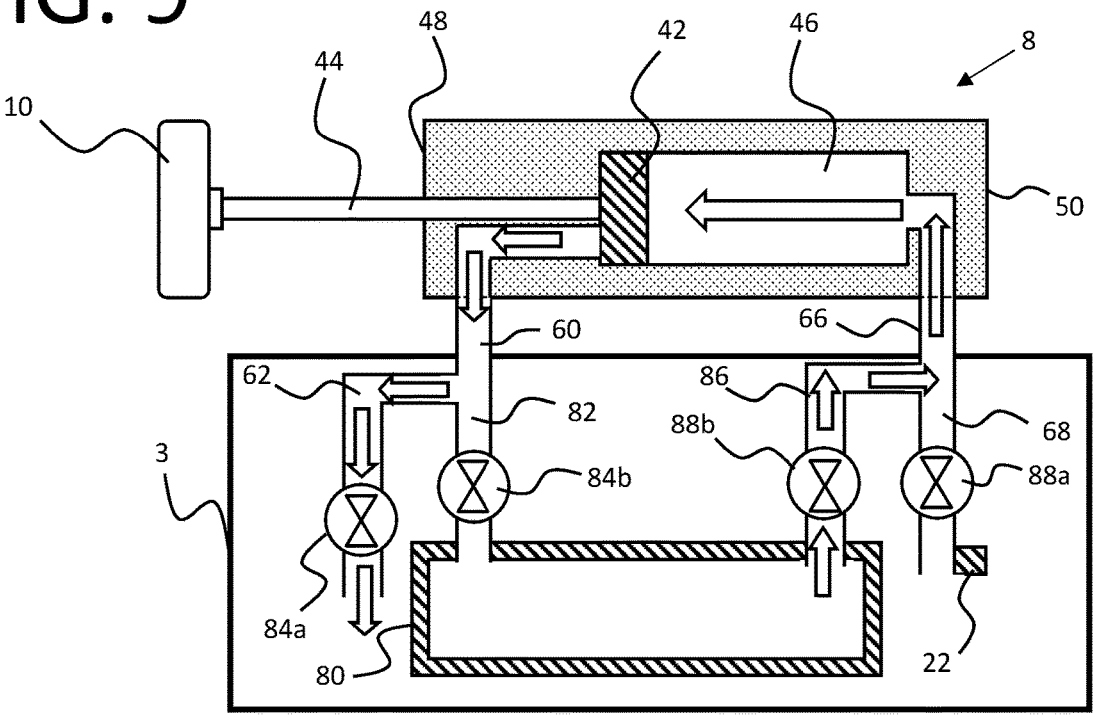

In FIG. 10, the linear actuator 8 is brought to extended mode, by pushing the piston 42 against the proximal side of the chamber. This is done by: (a) opening the second distal two-way valve to cause pressurized air from the reservoir 80 to enter the cavity 46; (b) closing the first distal two-way valve 88*a* to prevent air from exiting the cavity via the distal equalization pipe 68; (c) closing the second proximal two-way valve 84*b* to prevent pressurized air from the reservoir 80 from entering the cavity 46; and (d) opening the first proximal two-way valve 84*a* to enable air to exit the cavity via the proximal equalization pipe 62. This creates a situation in which air pressure is larger in the region of the cavity located between the piston 42 and the distal side 50 than in the region of the cavity located between the piston 42 and the proximal side 48. Thus, the piston 42 is pushed toward the proximal side 48, and in turn pushes the shaft 44 and the hitting pad 10. Air flow during the motion of the piston is shown by the solid white arrows.

Once the piston 42 reaches its fully extend position (which may be indicated by reed switches, for example, or by a stoppage of air flow through the proximal equalization pipe 62): (a) the second distal two-way valve 88*b* is closed; (b) the first distal two-way valve 88*a* is opened; (c) the second proximal two-way valve 84*b* is maintained closed; and (d) the first proximal two-way valve 84*a* is maintained open. In this manner, the linear actuator 8 is ready for impact.

Figure 11:
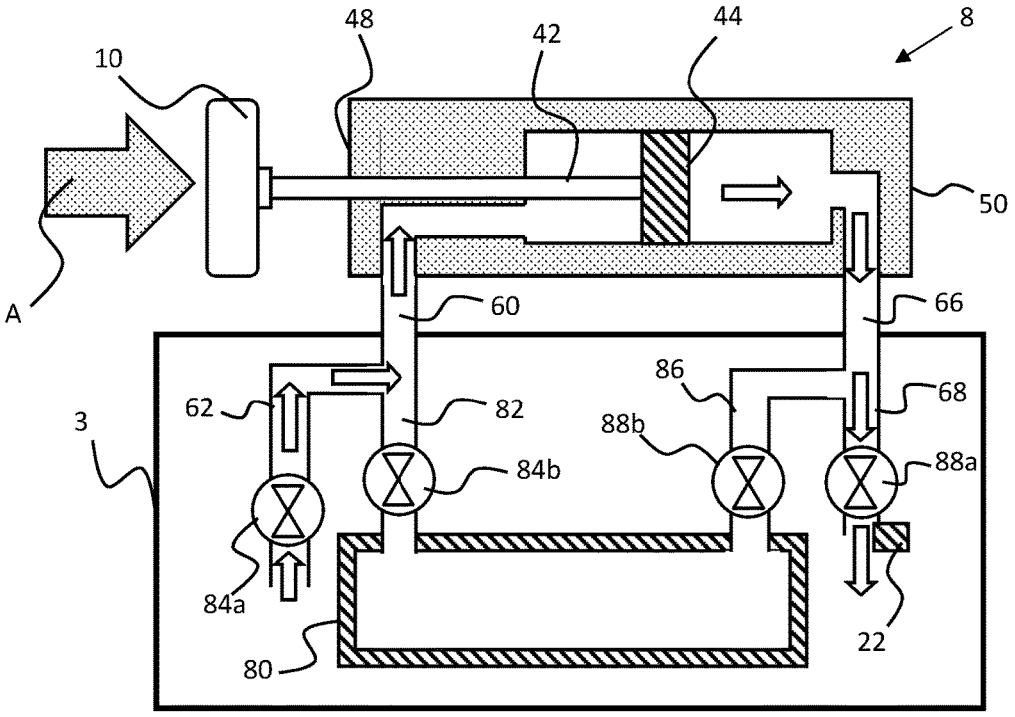

In FIG. 11, the hitting pad 10 is hit by the user. The direction of the impact is shown by the arrow A. The piston 44 is pushed partially toward the distal side 50. Air flow out of the cavity via the open distal equalizing pipe 68. The pressure/flow of the air is measured by the sensor 22 and sensor data is transmitted to the control apparatus to calculate the force of the impact.

In order to equalize pressure within the cavity 46, air from the external environment enters the cavity 46 via the open proximal equalizing pipe 62. A sensor may be placed at or near the open proximal equalizing pipe 62 as well (or instead of the sensor 22 at the distal equalizing pipe 68), since the pressure/flow of the air entering the cavity via the proximal equalizing pipe 62 is also indicative of the force of the impact.

Figure 12:
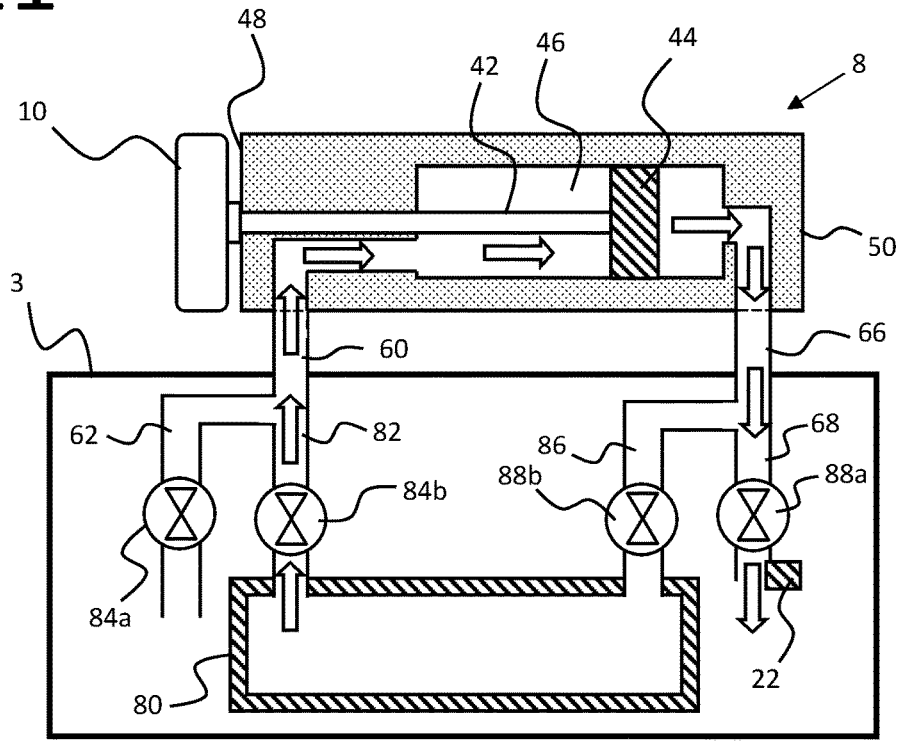

In FIG. 12, right after the end of the impact, the linear actuator 8 is returned to the retracted mode and the hitting pad 10 is retracted back to the proximal side 48 of the chamber.

This is accomplished by: (a) closing the first proximal two-way valve 84*a*; (b) opening the second proximal two-way valve 84*b*, to create flow of pressurized air from the tank 80 to the cavity 46; (c) maintaining the first distal two way valve 88*a* open, to enable pressure equalization via air flow from the cavity 46 to the external environment via the distal equalization pipe 68; and (d) maintaining the second distal two-way valve closed. In this manner air pressure is larger in the section of the cavity between the proximal side 48 and the piston 44 than in the section of the cavity between the piston 44 and the distal side 50. The air pressure difference pushes the piston toward the distal side 50 until the hitting pad 10 is retracted to its closest position to the proximal side 48. Air flow during the motion of the piston 44 is illustrated by the solid white arrows.

Figure 13:
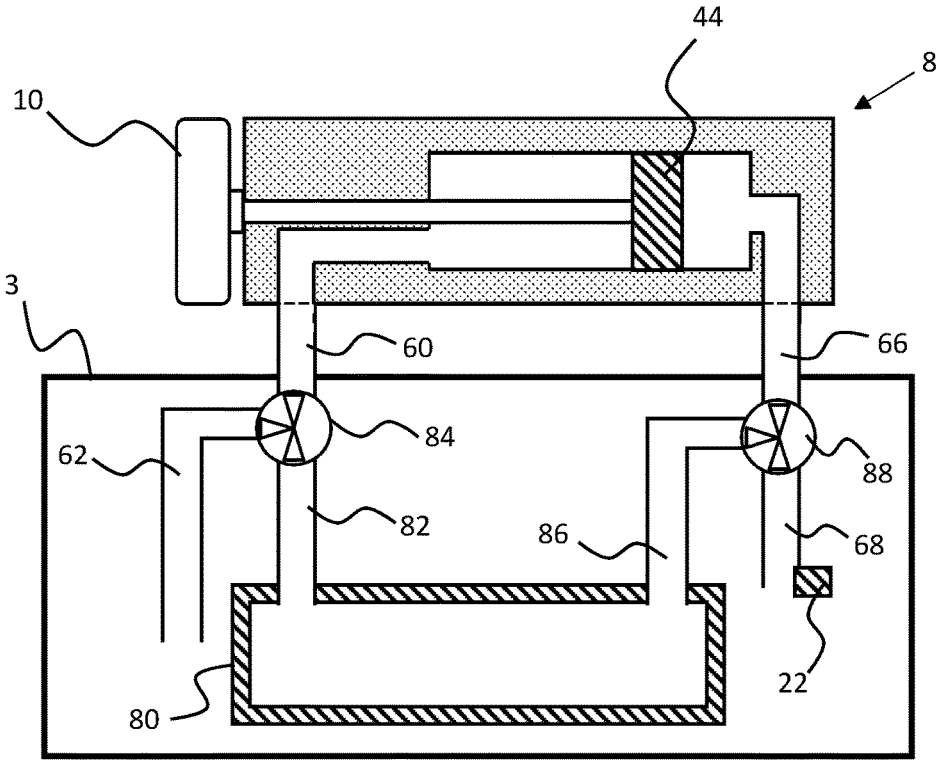
FIG. 13 illustrates a pneumatic linear actuator controlled via two three-way valves, according to some embodiments of the present invention.

FIG. 13 illustrates a pneumatic linear actuator 8 controlled via two three-way valves, according to some embodiments of the present invention.

In the variant of FIG. 13, the proximal valve device 84 is in the form of a proximal three-way valve joined to the proximal equalization pipe 62, the proximal connection pipe 60, and the proximal reservoir pipe 82. The distal valve device 88 is in the form of a distal three-way valve joined to the distal equalization pipe 68, the distal connection pipe 66, and the distal reservoir pipe 86.

The proximal three-way valve 84 is controlled by the control apparatus to be in one the following modes: (a) opening fluid communication between the proximal reservoir pipe 82 and the proximal connection pipe 60, while preventing fluid communication between the proximal equalization pipe 62 and the proximal connection pipe 60, and preventing fluid communication between the proximal equalization pipe 62 and the proximal reservoir pipe 82; (b) opening fluid communication between the proximal equalization pipe 62 and the proximal connection pipe 60, while preventing fluid communication between the proximal reservoir pipe 82 and the proximal connection pipe 60, and preventing fluid communication between the proximal equalization pipe 62 and the proximal reservoir pipe 82.

The distal three-way valve 88 is controlled by the control apparatus to be in one the following modes: (a) opening fluid communication between the distal reservoir pipe 86 and the distal connection pipe 66, while preventing fluid communication between the distal equalization pipe 68 and the distal connection pipe 66, and preventing fluid communication between the distal equalization pipe 68 and the distal reservoir pipe 86; (b) opening fluid communication between the distal equalization pipe 68 and the distal connection pipe 66, while preventing fluid communication between the distal reservoir pipe 86 and the distal connection pipe 66, and preventing fluid communication between the distal equalization pipe 68 and the distal reservoir pipe 86.

It is apparent that via the control of the three-way valves 84 and 88, the position of the piston 42 in linear actuator 8 (and consequently, the position of the hitting pad 10 can be controlled) in the same manner described in FIGS. 9-12.

Figure 14:
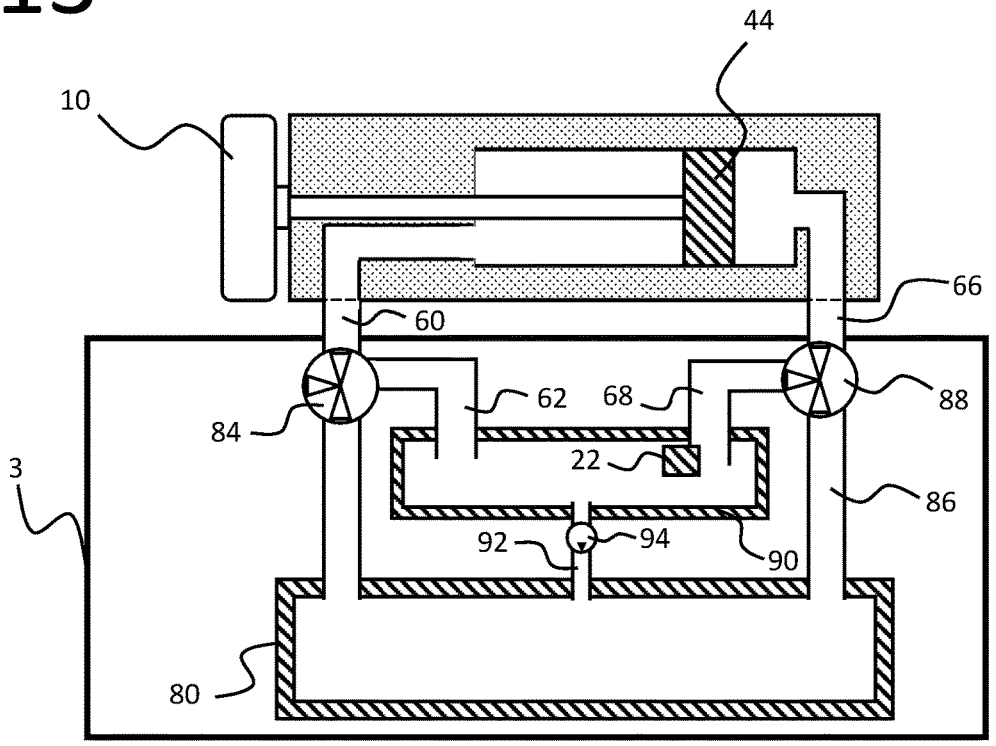
FIG. 14 illustrates a hydraulic linear actuator controlled via two three-way valves, according to some embodiments of the present invention.

FIG. 14 illustrates a hydraulic linear actuator controlled via two three-way valves, according to some embodiments of the present invention.

The linear actuator 8 of the example FIG. 14 is controlled by a liquid flow rather than an air flow. Therefore, the reservoir 80 is a reservoir of pressurized liquid. The valve further includes a reservoir of unpressurized liquid 90, which is connected to the reservoir 80 by a duct 92 and a pump 94.

The proximal equalization pipe 62 and the distal equalization pipe 68 do not open to air. Rather, the proximal equalization pipe 62 and the distal equalization pipe 68 open to reservoir of unpressurized liquid 90. In this manner, any liquid driven away from the cavity is collected in the reservoir of unpressurized liquid 90 and can be used to equalize pressure in the cavity 46 and can be pumped into the reservoir of unpressurized liquid 90 to replenish the reservoir of unpressurized liquid 90.

The sensor 22 measures liquid flow out of the distal equalization pipe 68, and/or liquid flow out of the proximal equalization pipe 62 to identify and impact event and for the calculation of the strength of the impact, as explained above.

While the example of FIG. 14 makes use of two three-way valves 84 and 88, the scope of the present invention also includes the use of four two-way valves as described with reference to FIGS. 9-12.

What is claimed is:

1. A training system for martial arts training, comprising:

a plurality of linear actuators, each of the plurality of linear actuators having an end configured to extend and retract;

a plurality of hitting pads, each of the hitting pads being joined to the end of a respective one of the plurality of linear actuators;

a control apparatus connected to the plurality of linear actuators and configured to control a position of the end of each linear actuator, thereby controlling the positions of the hitting pads;

a plurality of sensors operatively connected to respective linear actuators and in communication with the control apparatus, the sensors being for sensing impacts to respective hitting pads;

a vertical primary support frame configured to be fixed to a ground;

a secondary frame slidable vertically on the primary support frame and lockable on the primary support frame at a desired height, wherein the plurality of linear actuators is joined to the secondary frame; and a back support frame having a section joined to the primary support frame, and a section extending behind the primary support frame and configured to be fixed to the ground or to a wall.

2. The training system of claim 1, comprising:

at least one vertical linear actuator configured to move the secondary frame along the primary support frame.

3. The training system of claim 1, wherein the control apparatus comprises a communication unit configured to communicate with an external communication device to receive from the external communication device instructions relating to a sequence for controlling the positions of the hitting pads.

4. The training system of claim 1, wherein the control apparatus is in communication with the sensors and is configured to receive sensor data and to process the sensor data to generate training data indicative of timing and force of the impacts to the hitting pads.

5. The training system of claim 4, comprising a user interface configured to receive and display the training data.

6. The training system of claim 4, wherein the control apparatus comprises a communication unit configured to communicate with an external communication device to send the training data to the external communication device for display.

7. The training system of claim 1, wherein at least one of the plurality of linear actuators comprises a double acting pneumatic cylinder comprising:

a chamber surrounding a cavity and extending and having a proximal side and a distal side, the chamber having a proximal port at or near the proximal side and distal port at or near the distal side, the proximal and distal ports being in fluid communication with the cavity and with an external environment outside the chamber;

a piston located inside the cavity and configured to move linearly in the cavity between the proximal side and the distal side, the piston being configured to prevent fluid communication between a section of the cavity proximal to the piston and a section of the cavity distal to the piston;

a shaft extending from the piston to a proximal side of the chamber and out of the proximal side of the chamber, the shaft having a proximal edge forming the end of the linear actuator joined to the hitting pad.

8. The training system of claim 7, comprising a valve apparatus which comprises:

a proximal connection pipe joined to the proximal port;

a proximal equalization pipe in fluid communication with the proximal connection pipe;

a distal connection pipe joined to the distal port;

a distal equalization pipe in fluid communication with the distal connection pipe;

wherein the sensor is configured to measure fluid flow in the proximal equalization pipe and/or the distal equalization pipe and generate fluid flow data in real time;

wherein the control apparatus is configured to receive fluid flow data from the sensor and process the fluid flow data in real time to detect an impact event and to indicate a strength of the impact.

9. The training system of claim 8, wherein the valve apparatus further comprises:

a reservoir of compressed fluid;

a proximal reservoir pipe in fluid communication with the proximal connection pipe and with the reservoir;

a proximal valve device configured to control fluid passage from the reservoir to the chamber's cavity via the proximal reservoir pipe, and between the chamber's cavity and the external environment via the proximal equalization pipe, the proximal valve device being controlled by the control apparatus;

a distal reservoir pipe in fluid communication with the distal connection pipe and with the reservoir;

a distal valve device configured to control fluid passage from the reservoir to the chamber's cavity via the distal reservoir pipe, and between the chamber's cavity and the external environment via the distal equalization pipe, the distal valve device being controlled by the control apparatus.

10. The training system of claim 8, comprising an electric motor configured to move the hitting pad, wherein the control unit is configured to control the electrical motor to control the position of the hitting pad.

11. A training system for martial arts training, comprising:

a plurality of linear actuators, each of the plurality of linear actuators having an end configured to extend and retract;

a plurality of hitting pads, each of the hitting pads being joined to the end of a respective one of the plurality of linear actuators;

a control apparatus connected to the plurality of linear actuators and configured to control a position of the end of each linear actuator, thereby controlling position of the hitting pads;

a plurality of sensors operatively connected to respective linear actuators and in communication with the control apparatus, the sensors being for sensing impacts to respective hitting pads;

wherein at least one of the plurality of linear actuators comprises a double acting pneumatic cylinder comprising:

a chamber surrounding a cavity and having a proximal side and a distal side, the chamber having a proximal port at or near the proximal side and distal port at or near the distal side, the proximal and distal ports being in fluid communication with the cavity and with an external environment outside the chamber;

a piston located inside the cavity and configured to move linearly in the cavity between the proximal side and the distal side, the piston being configured to prevent fluid communication between a section of the cavity proximal to the piston and a section of the cavity distal to the piston;

a shaft extending from the piston to a proximal side of the chamber and out of the proximal side of the chamber, the shaft having a proximal edge forming the end of the linear actuator joined to the hitting pad.

12. The training system of claim 11, comprising an electric motor configured to move the hitting pad, wherein the control unit is configured to control the electrical motor to control the position of the hitting pad.

13. The training system of claim 11, further comprising a valve apparatus which comprises, for each linear actuator:

a proximal connection pipe joined to the proximal port;

a proximal equalization pipe in fluid communication with the proximal connection pipe;

a distal connection pipe joined to the distal port;

a distal equalization pipe in fluid communication with the distal connection pipe;

wherein each sensor is configured to measure fluid flow in the proximal equalization pipe and/or the distal equalization pipe and generate fluid flow data in real time;

wherein the control apparatus is configured to receive fluid flow data from the sensor and process the fluid flow data in real time to detect an impact event and to indicate a strength of the impact.

14. The training system of claim 13, wherein the valve apparatus further comprises a reservoir of compressed fluid and, for each linear actuator:

a proximal reservoir pipe in fluid communication with the proximal connection pipe and with the reservoir;

a proximal valve device configured to control fluid passage from the reservoir to the chamber's cavity via the proximal reservoir pipe, and between the chamber's cavity and the external environment via the proximal equalization pipe, the proximal valve device being controlled by the control apparatus;

a distal reservoir pipe in fluid communication with the distal connection pipe and with the reservoir;

a distal valve device configured to control fluid passage from the reservoir to the chamber's cavity via the distal reservoir pipe, and between the chamber's cavity and the external environment via the distal equalization pipe, the distal valve device being controlled by the control apparatus.

15. The training system of claim 1, further comprising a user interface configured to receive from user instructions relating to a sequence for controlling the positions of the hitting pads.

* * * * *